US008230781B2

(12) United States Patent
Schaltegger et al.

(10) Patent No.: US 8,230,781 B2
(45) Date of Patent: Jul. 31, 2012

(54) MECHANICAL PRESS FOR FINE BLANKING, FORMING AND/OR STAMPING OF WORK PIECES

(75) Inventors: Markus Schaltegger, Berne (CH); Alfio Cristofaro, Reichenburg (CH); Juerg Ochsenbein, Berne (CH); Lukas Hueppi, Walde (CH)

(73) Assignee: Feintool Intellectual Property AG, Lyss (CH)

( * ) Notice: Subject to any disclaimer, the term of this patent is extended or adjusted under 35 U.S.C. 154(b) by 122 days.

(21) Appl. No.: 12/793,127

(22) Filed: Jun. 3, 2010

(65) Prior Publication Data

US 2010/0319554 A1 Dec. 23, 2010

(30) Foreign Application Priority Data

Jun. 3, 2009 (EP) ..... 09007351

(51) Int. Cl.
*B30B 1/14* (2006.01)
*B26D 5/18* (2006.01)

(52) U.S. Cl. ..... 100/283; 100/282; 100/286; 72/451; 83/630

(58) Field of Classification Search ..... 100/272, 100/281, 282, 283, 286; 72/450, 451; 74/38, 74/40, 44, 45; 83/630
See application file for complete search history.

(56) References Cited

U.S. PATENT DOCUMENTS

| | | | | |
|---|---|---|---|---|
| 4,920,782 | A * | 5/1990 | Hellwig | 72/451 |
| 4,944,221 | A * | 7/1990 | Leinhaas | 100/286 |
| 6,405,576 | B1 * | 6/2002 | Endo et al. | 72/451 |
| 6,708,609 | B1 | 3/2004 | Koerner et al. | |
| 6,805,045 | B1 * | 10/2004 | Korner et al. | 100/193 |
| 2002/0104364 | A1 * | 8/2002 | Fahrenbach | 72/451 |

* cited by examiner

*Primary Examiner* — Jimmy T Nguyen
(74) *Attorney, Agent, or Firm* — Jordan and Hamburg LLP

(57) ABSTRACT

A mechanical press for fine blanking, forming and/or stamping of work pieces has a machine frame provided with a head piece and an O-shaped frame, the head piece receiving in a fixed arrangement a fine blanking or forming head having an upper tool part, a ram provided in the O-shaped frame having a table top for fixing a lower tool part, the ram being actuable along a vertical stroke axis, and a toggle mechanism with a first and second side that is positioned below the ram. The toggle mechanism includes a connecting rod having a substantially equilateral triangle shape with articulation points pivotally attached to arms that pivot about a fixed bearing on the press machine and the ram, respectively, as well as around the connecting rod. Another portion of the connecting rod is attached to synchronous motors through a gear and shaft arrangement at another fixed bearing on the machine press. A computer controller adjusts the motors to equal path-time characteristics.

11 Claims, 10 Drawing Sheets

MECHANICAL PRESS FOR FINE BLANKING, FORMING AND/OR STAMPING OF WORK PIECES

BACKGROUND OF THE INVENTION

The invention relates to a mechanical press for fine blanking, forming and/or stamping of work pieces, the press having a machine frame assembled of a head piece and an O-shaped frame, a fine blanking or forming head with a fixed upper tool part suspended from the head piece and projecting into the O-piece, a ram vertically guided on a stroke axis in the O-shaped frame provided with a table top for fixing a lower tool part and a positioned below the ram toggle mechanism.

DE 199 35 656 A1 discloses a line of presses with a modified position above a table toggle mechanism which is driven via an electric motor by an eccentric shaft rotatably run on bearings provided with a torsion rigid eccentric and using an interconnected flywheel. The eccentric has a connecting rod with a respective connecting rod bearing. The connecting rod at its end not adjoining the eccentric has a head, on which are developed two bearing points arranged apart from each other. These bearing points, with the center of the connecting rod, define a triangle. A first splicing plate is connected via a bearing pin to the head piece of the machine frame, providing a fixed bearing. The other end of the splicing plate is pivoted to the connecting rod by another bearing pin. A second splicing plate is attached to the ram at one end and to the connecting rod at the other end. The fixed bearing of the modified toggle is positioned above the press ram and the articulation point allocated to this fixed point swivels around this fixed point. The upper articulation point defines a curved path. Such a modified toggle mechanism causes ram movement to slow down, so that the material in the lower dead point has enough time for plastic flow.

However, it is disadvantageous that the fixed bearing of the splicing plate allocated to the connecting rod and the ram lie on different axes and further that the fixed bearing for the eccentric shaft is positioned near the ram. As a result, in the upper dead point, an almost effective length of the splicing plates can not be achieved, so that the rigidity and thus the power transmission onto the ram is always accompanied by horizontally acting force components, whereby the ram wear and also the power applied to the ram have to be increased. This has negative consequences for the machine frame, which has to be designed to be more massive, and for the driving power of the motors, which have to achieve higher turning moments.

FIG. 1 shows toggle press 1 as disclosed in DE 199 35 656. In a machine frame 2, a vertically movable ram 3 is positioned. Below the ram 3 is positioned a table 4 (see FIG. 2) which is attached to the machine frame 2. The table 4 is used for taking up a lower tool and the ram 3 is prepared for taking up an upper tool.

The ram 3 is actuated by a ram drive which includes a modified toggle mechanism 5 driven by an eccentric shaft 6, in turn driven via a transmission means, for example a toothed wheel, and by an electrical motor. Between the electrical motor and the toothed wheel an attached transmission gear, an epicyclic gear, for example, can be positioned.

The kinematics of the toggle mechanism 5 can be seen from FIGS. 1 and 2. On the eccentric shaft 6, which is turnable on a bearing position L1, an eccentric element 7 is positioned. Attached to the eccentric element 7 is a connecting rod 8 provided with a connecting rod bearing 9. The connecting rod 8 at its end distal to the eccentric element 7 has a head 10, at which two bearing positions 11 and 12 are distanced from each other. The bearing positions together with the center of the connecting rod bearing 9 define a triangle, as shown in FIG. 2 where the respective distances are referred to as distances E5, E6 and E8. The eccentricity of the eccentric element 7 is indicated by reference point E4. The eccentric shaft 6 is turnable around a rotation axis D, which is fixed in the machine frame 2. Thus, L1 defines the fixed bearing for the eccentric shaft 6.

The connecting rod 8 is connected by link bars 13 and 14 to the machine frame 2 and to the ram 3. The link bar 13, through bearing pin 15 pivotally attaches arm 13 to the connection area 16 of the connecting rod 8, and bearing pin 17 attaches arm 13 to the machine frame 2. Bearing pin 17 of the link bar 13 forms a fixed bearing L2 which is positioned above the ram 3 and table 4. The link bar 13 in FIG. 2 is referred to as E7. Link bar 14 at its one end pivots around a bearing pin 18 in the connection area 19 of connection rod 8, and the other end of articulated arm 14 pivots around a bearing pin 20 in the ram 3.

The fixed bearing L2, that is the fixed point, with which the articulated arm 13 is fixed to the machine frame 2, does not lie on the vertical stroke axis HU of the ram 3. Thus, link bars 13 and 14 do not reach a sufficient effective length at the upper dead point OT, so that operation translates in part to an unwanted horizontal force component applied to the ram 3. This adversely affects the useful life of the ram and contributes to a reduction in force that the ram can apply in the fine blanking or forming operation. This leads to higher turning moments, in order to compensate for the generation of unwanted horizontal force components. Also, to compensate, the machine frames must be made more massive, that is, made with higher weight and stability, in order to compensate for the horizontal forces.

SUMMARY OF THE INVENTION

The present invention provides a mechanical press for fine blanking, forming and stamping operations that operates without a flywheel, yet significantly enhances the rigidity of the toggle mechanism at the upper dead point, reduces the massiveness of the machine frame, and works with a significantly reduced driving power despite of the abolished flywheel.

According to the present invention, the vertical stroke axis of the ram is positioned on the axis between the ram and fixed bearing. which are in connection with a triangular-shaped connecting rod through upper and lower articulated arms connecting the fixed bearing, the connecting rod, and the ram. This structural arrangement can reach an almost effective length at the upper dead point of the ram.

At the effective length, the aforedescribed structure is in a near parallel arrangement, relative to the vertical stroke axis, meaning that force applied by this structure to the ram is only minimally, if not at all, in a horizontal direction. Thus, very low horizontal forces act on the ram, so that an almost optimum transmission of power from the motor through the eccentric shaft and aforedescribed structure to the ram, while avoiding considerable loss and wear of the ram can be realized.

This result is achieved by positioning a toggle mechanism containing the above structural arrangement, which does not have a flywheel, below the ram, the toggle mechanism having a first and second side, which first and second side are respectively positioned on first and second sides of the ram. In a more specific aspect of the present invention, the toggle mechanism having first and second sides includes a connecting rod having a substantially equilateral triangle shape having upper and lower articulation points positioned at triangle corners, in which the lower articulation point is attached to a lower articulated arm that is also affixed to a first fixed bearing positioned on the O-shaped frame, the lower articulated arm pivoting around the first fixed bearing, the upper articulation point of the connecting rod being attached to an upper articulated arm that is pivotally attached to the ram, the connecting rod, at a third triangle corner, being connected to a gear housed in a second fixed bearing on the O-shaped frame, whereby, during motor-driven actuation of a shaft in connection with the gear housed in the O-shaped frame, at a moment when the ram is located at an upper dead point of the vertical stroke axis, the upper articulated arm, the connecting rod, and the lower articulated arm reach an almost effective length with regard to the vertical stroke axis of the ram, the effective length deviating only a few degrees from the vertical stroke axis to thereby have length substantially similar to a length of the vertical stroke axis. The motors that drive actuation can be three-phase synchronous motors that drive the first and second sides of the toggle mechanism in parallel and simultaneously, wherein the motors are adjustable to equal path-time characteristics by means of a computer control that is connected to the motors.

The fixed bearings for the eccentric shafts and the lower articulated arms are positioned at their base at the O-shaped frame. This, in connection with the driving concept according to this invention, positions the fixed bearings at the base of the machine frame, and thus very near the center of gravity of the whole press construction. This allows for a reduction of mass of the machine frame.

According to a further aspect of the invention, the second fixed bearing has a pair of frame portions having openings in sides thereof and a pocket located between the pair of frame portions, the eccentric shaft being positioned in the openings in the sides and within the pocket.

In a further aspect of the invention, the ends of the eccentric shafts that face each other are mechanically connected to each other by a coupling piece.

In accordance with the present invention, the three-phase synchronous motors are controlled in unison by the computer and triggered as one unit, so that the path-time characteristics of the motors are identical.

In a further aspect of the invention the ends of the eccentric shafts facing each other are not connected to each other. The three-phase synchronous motors, independently of each other, transmit their respective driving power, without a transmission gear, to the eccentric shafts. Each three-phase synchronous motor is separately triggered by the computer and adjusted as necessary to have to identical path-time characteristics. It also should be noted that different path-time characteristics can be selected to compensate a possible overturning of the ram in case of eccentric loading of the tool.

Three-phase synchronous motors with high torque at low rotational speed of the motor, for example torque motors, have been found to be well suited for use in the present invention.

Also well suited for inclusion are epicyclic transmission gears which provide for a lower inertia of mass in a compact design.

In yet another aspect of the invention, the head piece is held at the O-shaped frame by a threaded connection, such as screw and threaded bore, without torsion stress. Further, the head piece and the O-shaped frame may be constructed of thin-walled high-strength ductile cast iron.

The following description and attached figures make apparent the details of the present invention and advantages that flow therefrom.

DETAILED DESCRIPTION OF THE INVENTION

Figure 1:
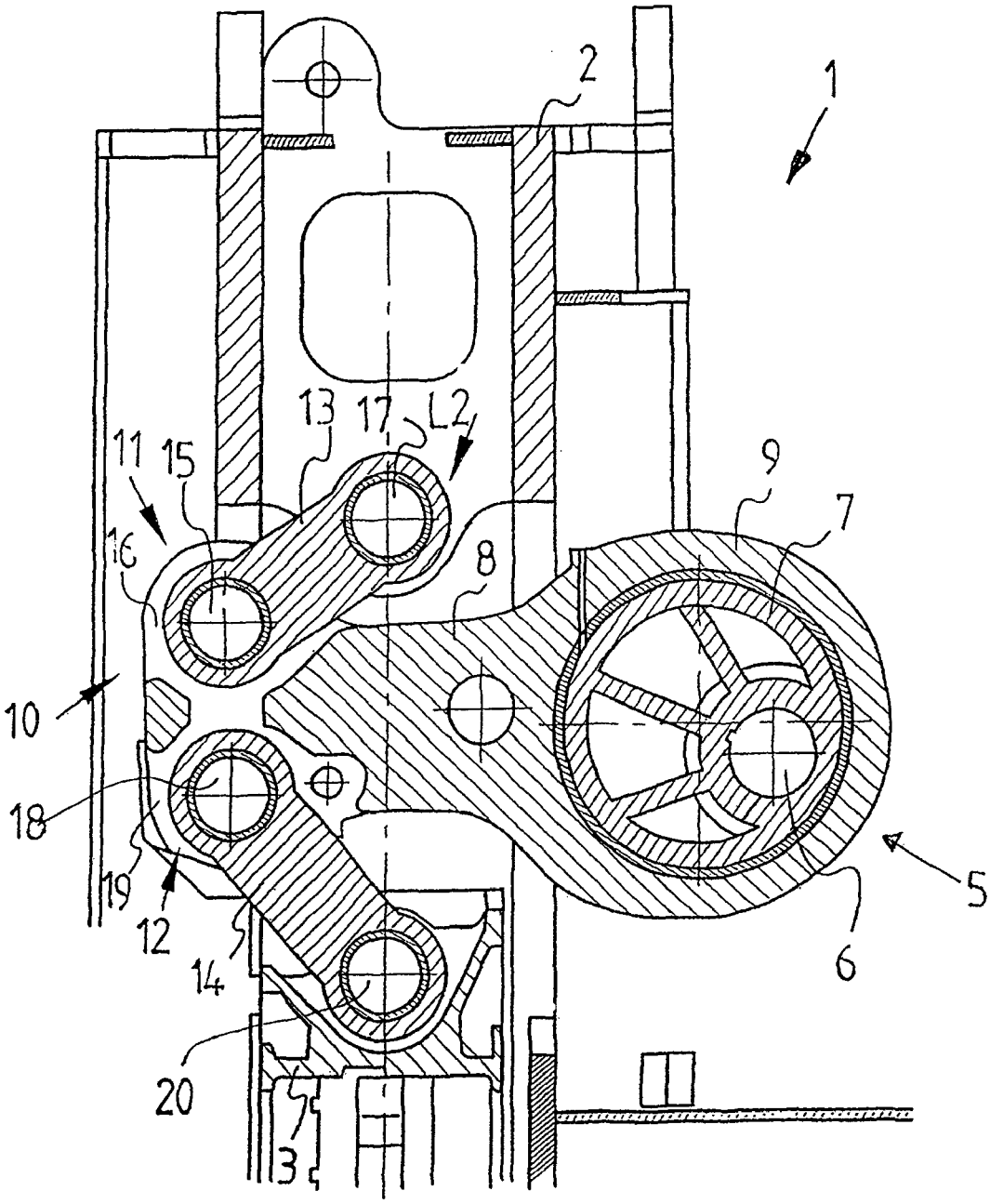
FIG. 1 PRIOR ART
FIG. 1 is a view of a toggle press according to the state of the art.
Figure 2:
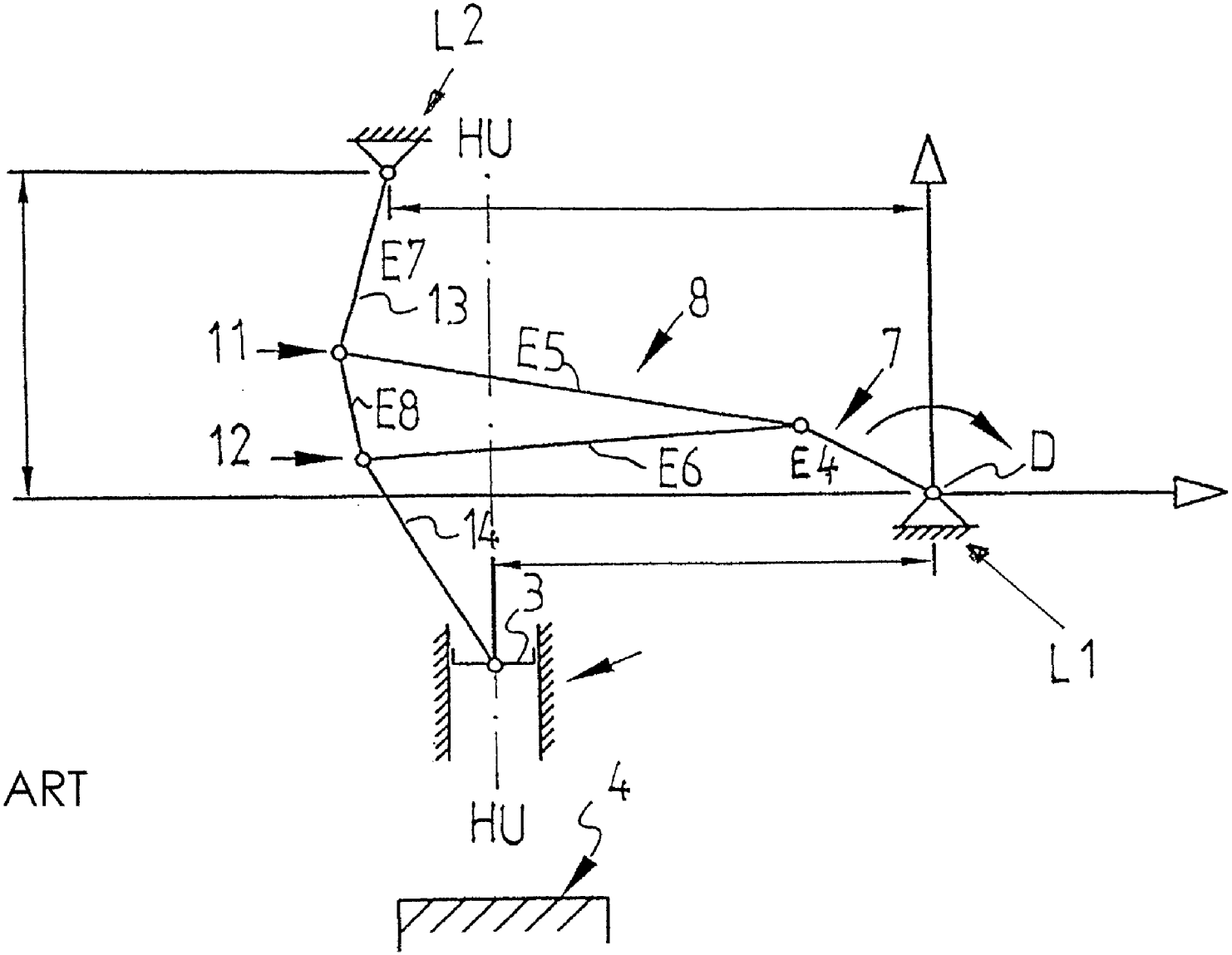
FIG. 2 PRIOR ART
FIG. 2 is a schematic view of the kinematics according to the state of the art.
Figure 3A:
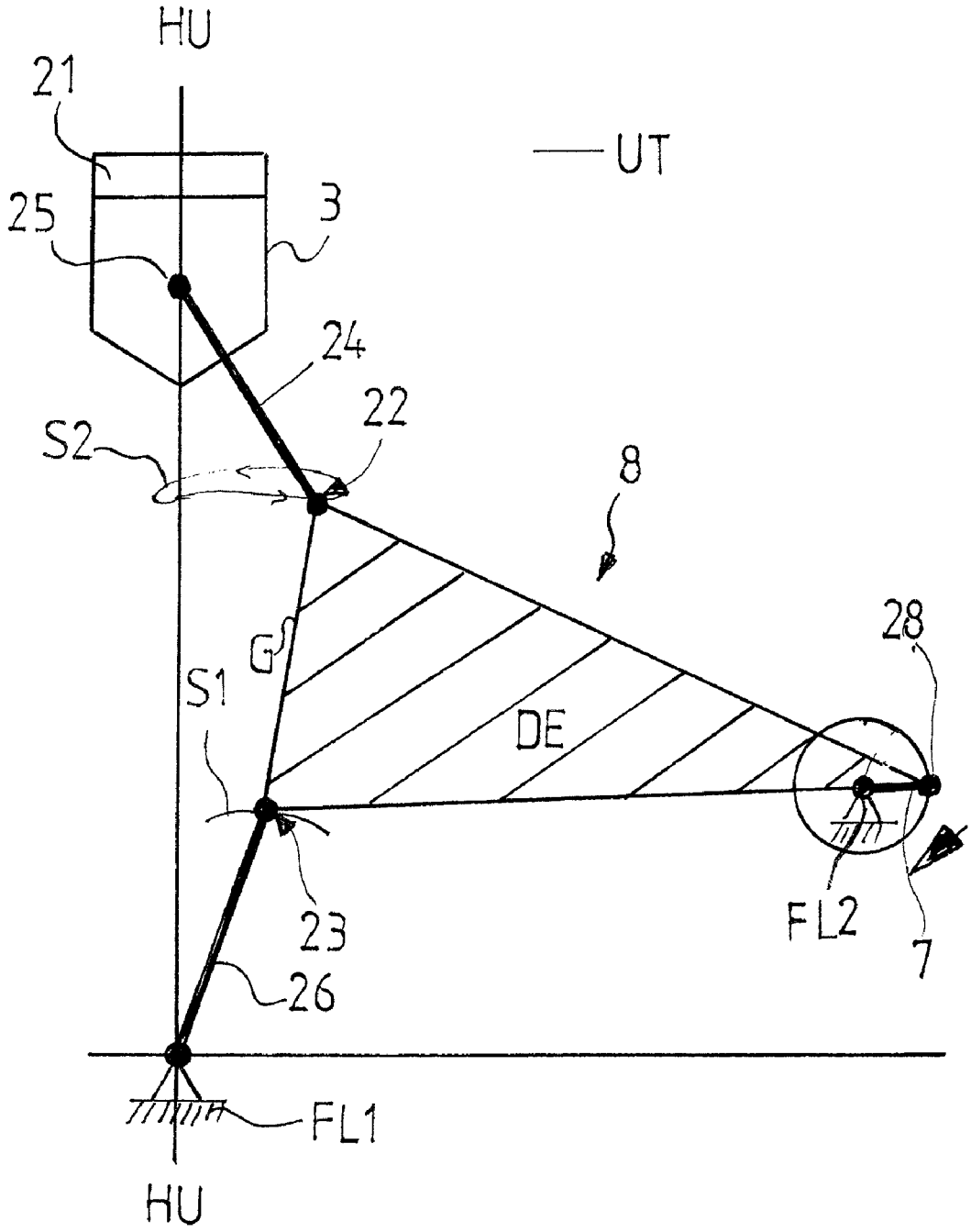
FIGS. 3*a* and 3*b* depict schematic views of the kinematics according to the invention in the lower and upper dead points UT and OT, respectively.
Figure 3B:
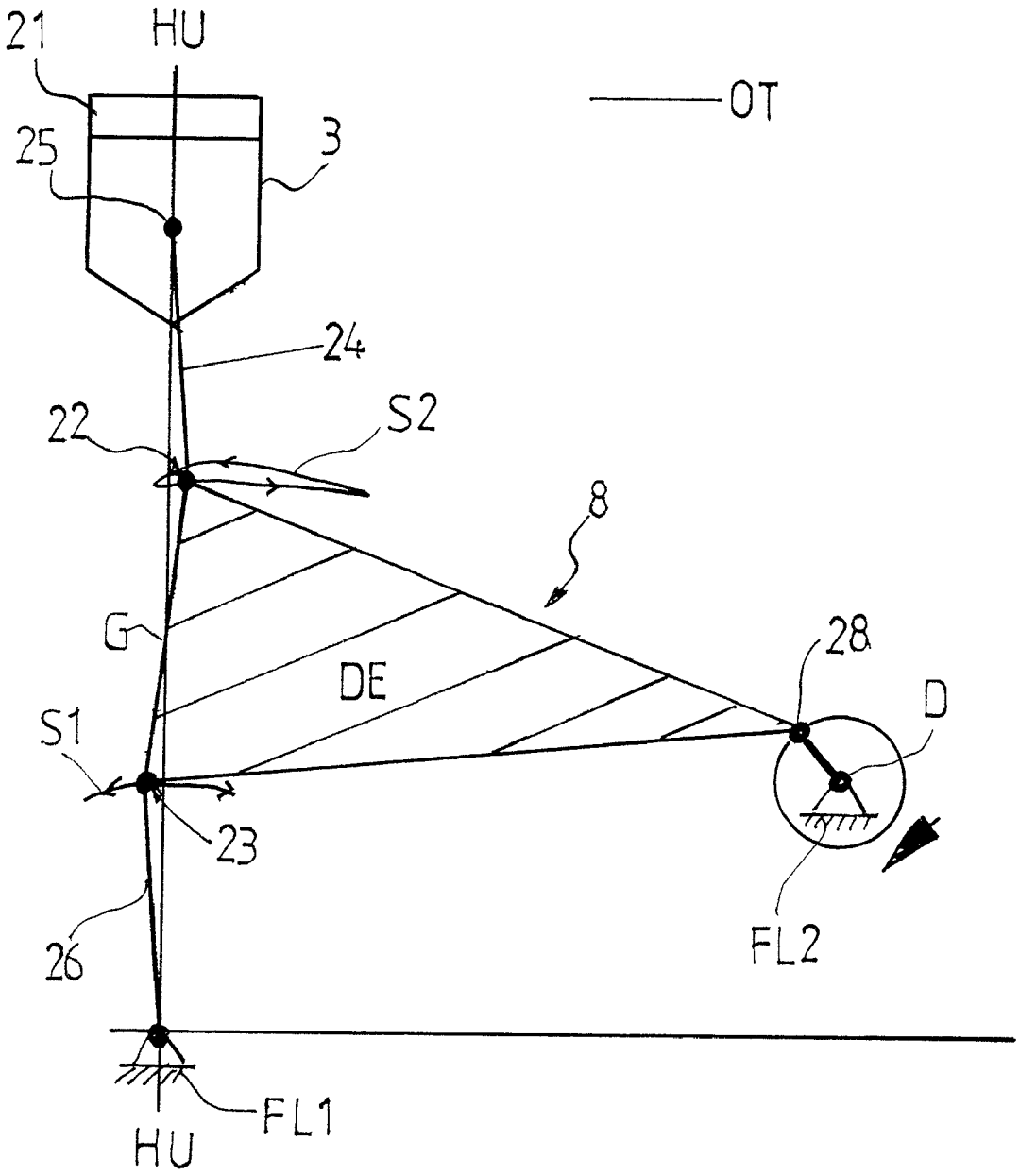
Figure 4:
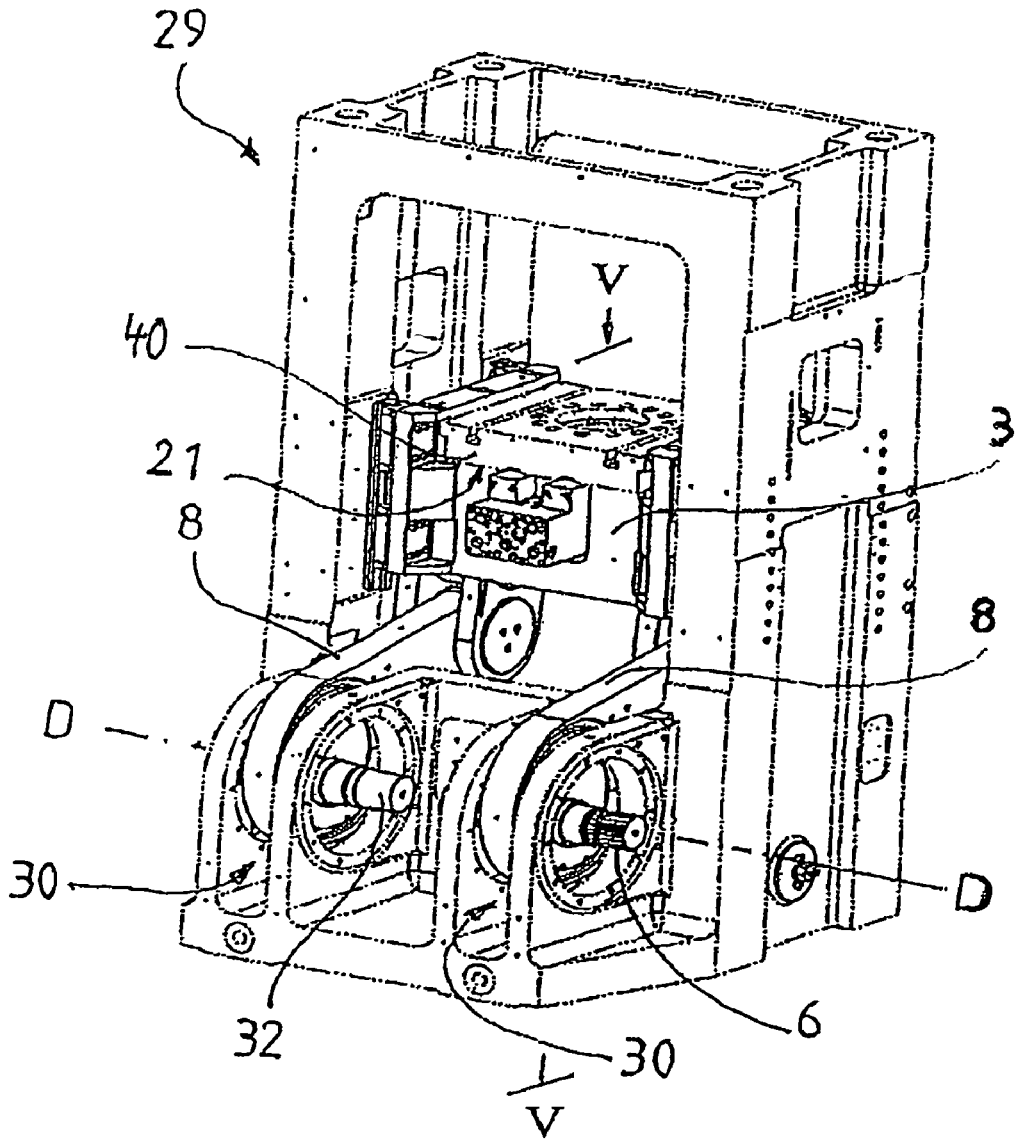
FIG. 4 is a perspective view of the O-shaped frame of the machine frame with ram and eccentric shafts, but without assembled head piece.

FIGS. 3*a* and 3*b* schematically show the kinematics of the toggle mechanism in the lower and upper dead points of the ram of the press according to the present invention. As shown in FIG. 4, the toggle mechanism, which includes components 6 and 8, among others, has a first and second side, positioned on either side of the ram 3. For convenience purposes, the following description shall, for the most part, concern one side of the toggle mechanism, with the understanding that the other side of the toggle mechanism has the same structure.

Figure 6:
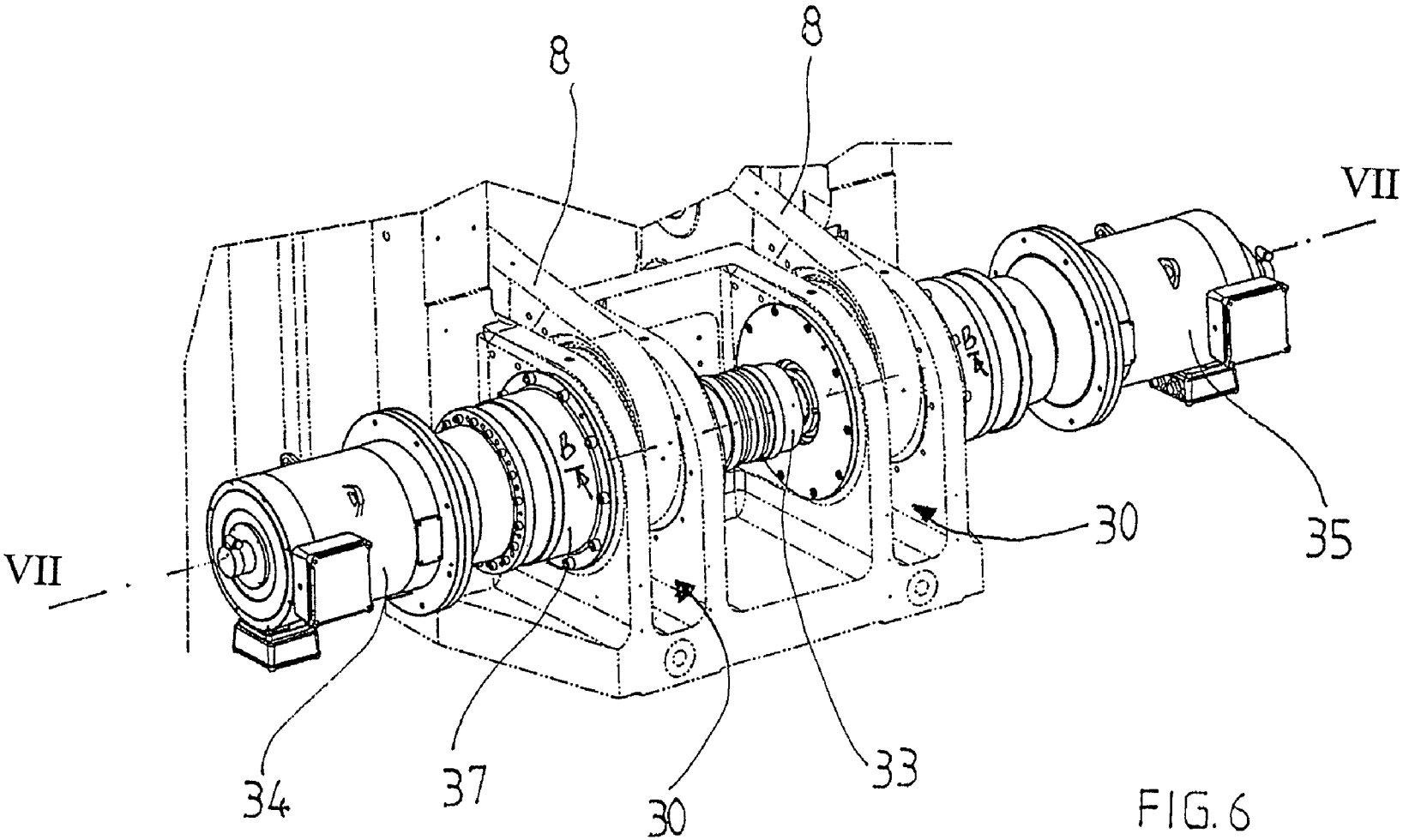
FIG. 6 is a cut out perspective view of the machine frame connected by eccentric shaft and transmission gear three-phase synchronous motors.
Figure 7:
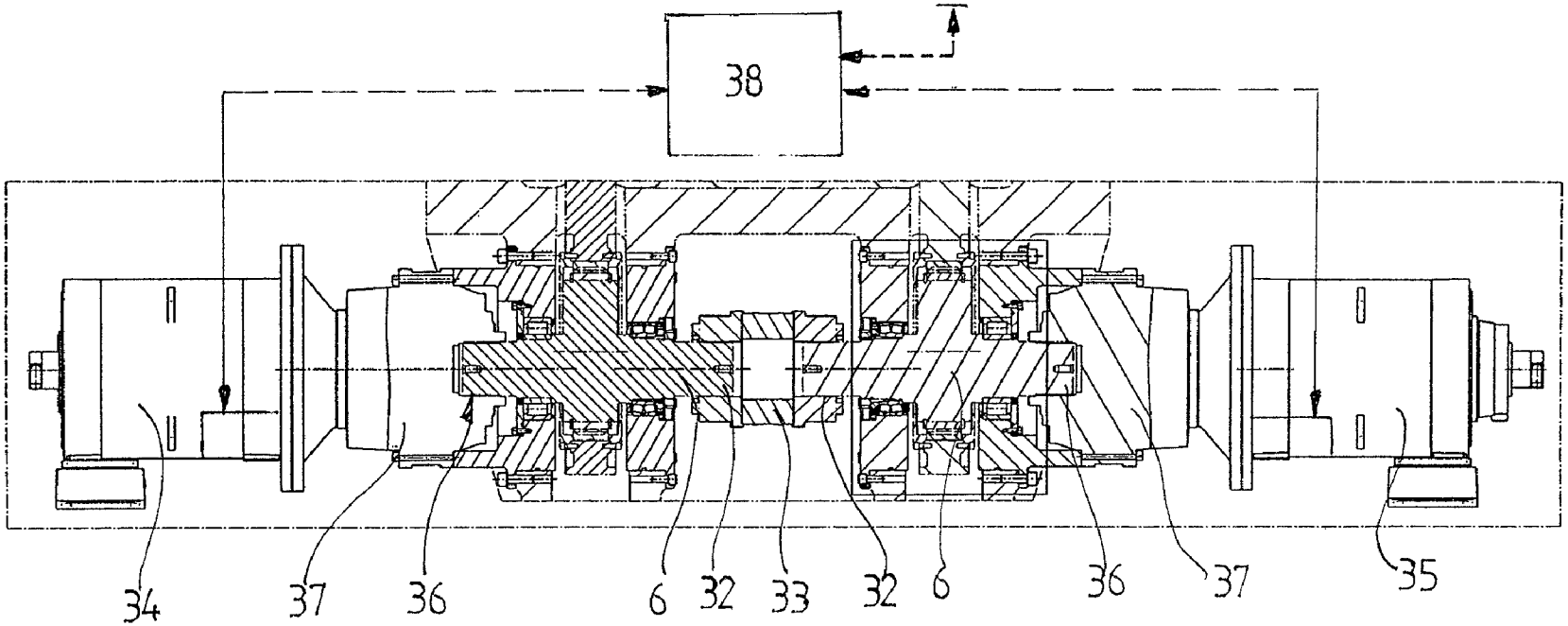
FIG. 7 is a cross-section along the line VII-VII of FIG. 6.

An eccentric shaft 6, in mechanical connection with eccentric 7, is driven by a three-phase synchronous motor, of which two are provided, one for each side of the toggle mechanism, in order to drive a respective pair of eccentric shaft and eccentric. On each side of the toggle mechanism, the eccentric shaft and eccentric is positioned below the ram 3, as shown in FIGS. 3*a*, 3*b*, and 4. FIGS. 6 and 7 show the three-phase synchronous motor and eccentric shaft positioned on each side of the ram.

As shown in FIGS. 3*a* and 3*b*, ram 3 supports a table top 21 on which a lower tool part 40 is fixed, which lower tool part 40 is not shown (but see FIG. 4), so that the table top 21 and tool part 40 also participate in a stroke movement.

The connecting rod 8, as shown in FIGS. 3*a* and 3*b*, schematically forms an equilateral triangle DE, having base side G that defines the head 10 of the connecting rod 8. The connecting rod 8 has two articulation points 22 and 23 in, respectively, an upper and lower arrangement at the triangle corners. Upper articulation point 22 of the connecting rod 8 is pivotally attached to one end of articulated arm 24, and the other end of the articulated arm 24 is pivotally attached to articulation point 25 of ram 3.

A fixed bearing FL1, aligned on the vertical stroke axis HU of the ram 3, having a base at machine frame 2, is fixed in place at the end of lower articulated arm 26, so that articulated arm 26 can pivot about fixed bearing FL1. Upper end of the articulated arm 26 is pivotally attached to the lower articulation point 23 of the connecting rod 8.

On the vertex of triangle DE, the connecting rod 8 is attached to the eccentric 7 at articulation point 28. The eccentric 7 is turnable around a stationary fixed bearing FL2, which is fixed to the machine frame 2. Fixed bearing FL2 is substantially in alignment with the lower articulation point 23, so that the fixed bearing FL1 of the lower articulated arm 26 and the fixed bearing FL2 of the eccentric shaft 6 with their bases can be positioned in or on the machine frame 2 and thus lie near the center of gravity of the whole press construction.

FIG. 3*a* shows ram 3 at lower dead point UT. Lower articulated arm 26 attached to the fixed bearing FL1 has pivoted, as indicated by swiveling path S1. Upper articulated arm 24 has moved about a curved path S2.

FIG. 3*b* shows ram 3 at upper dead point OT. Articulated arms 24, 26 and the base side G of the connecting rod 8 are almost in a linear arrangement i.e., almost effective length, as the articulated arms 24 and 26 are angled only about 4° with respect to the stroke axis HU of the ram 3.

Thus, during transmission of power to ram 3, the generation of a horizontal force component is minimized, so that the transmission of power from the drive to the ram occurs almost without loss, and furthermore, wear on the ram 3 at its ram guiding is reduced.

Figure 8:
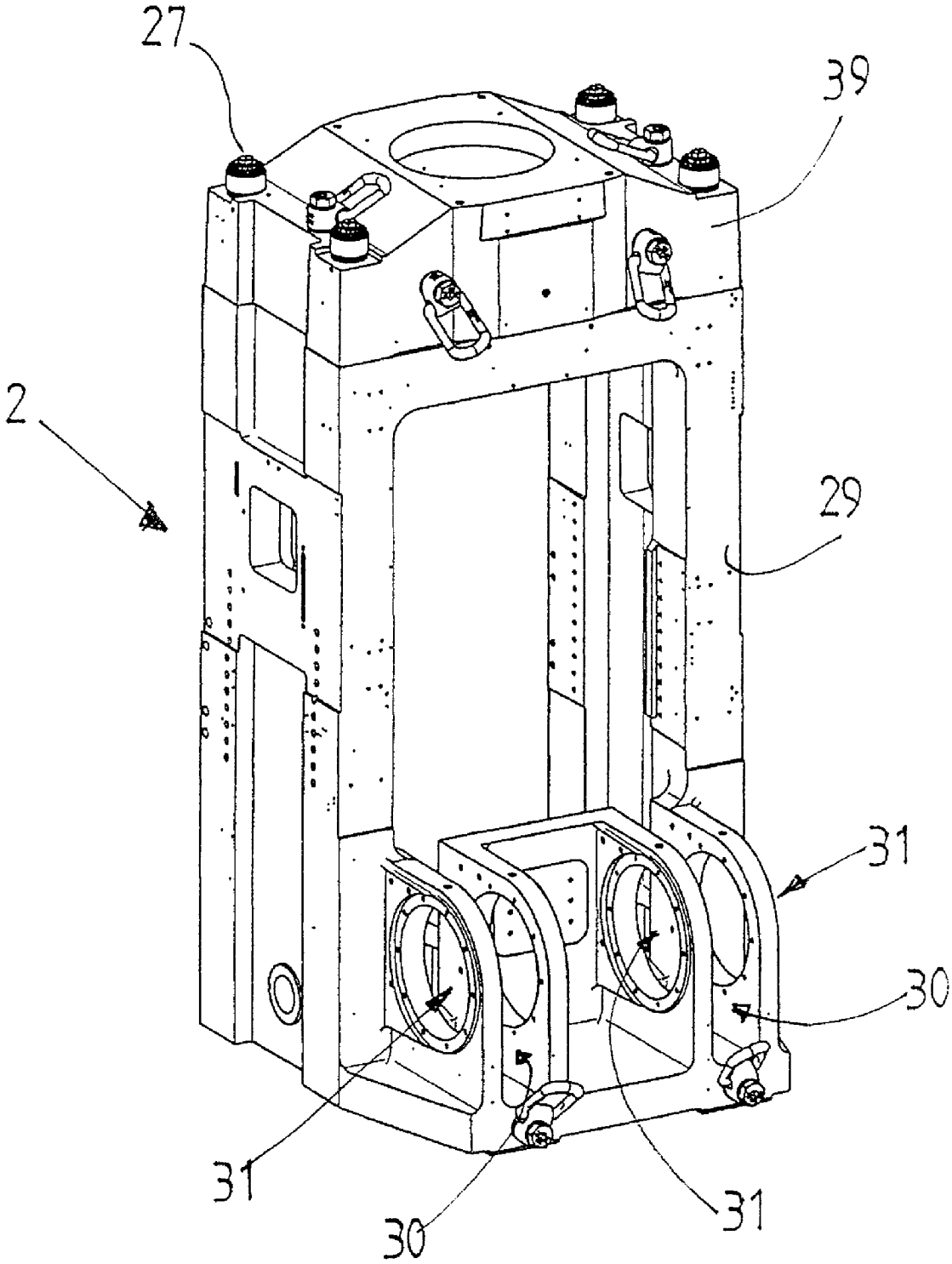
FIG. 8 is a perspective view of the machine frame showing the O-shaped frame with head piece.

FIG. 4 shows a perspective view of the O-shaped frame 29 part of the machine frame 2 including assembled ram 3. The O-shaped frame 29 may be fabricated of high-strength ductile cast iron. As shown in FIG. 8, side openings 31 are provided in matched pairs of frame portions (see FIG. 8) located at the base of the rear side of the O-shaped frame 29. Pockets 30 are located between the matched pairs of frame portions. Eccentric shafts 6 are positioned in each of the pockets 30. Each eccentric shaft has an axis D that are in alignment with each other. As shown in FIG. 6, ends 32 of the eccentric shafts 6 that face each other are rigidly connected to each other by a coupling piece 33. Each of the eccentric shafts 6 extends into the pockets 30 through openings 31. The eccentric shafts further extend into connecting rods 8, which connecting rods extend into the slot side provided in the pockets 30. Connecting rod bearings connect the eccentric shafts 6 to the connecting rods. The connection can be through a gear, such as an epicyclical gear.

Pockets 30 in the O-shaped frame 29 provide the fixed bearings FL2 for the eccentric shafts 6, and support the three-phase synchronous motors 34 and 35 (see FIG. 6).

Figure 5:
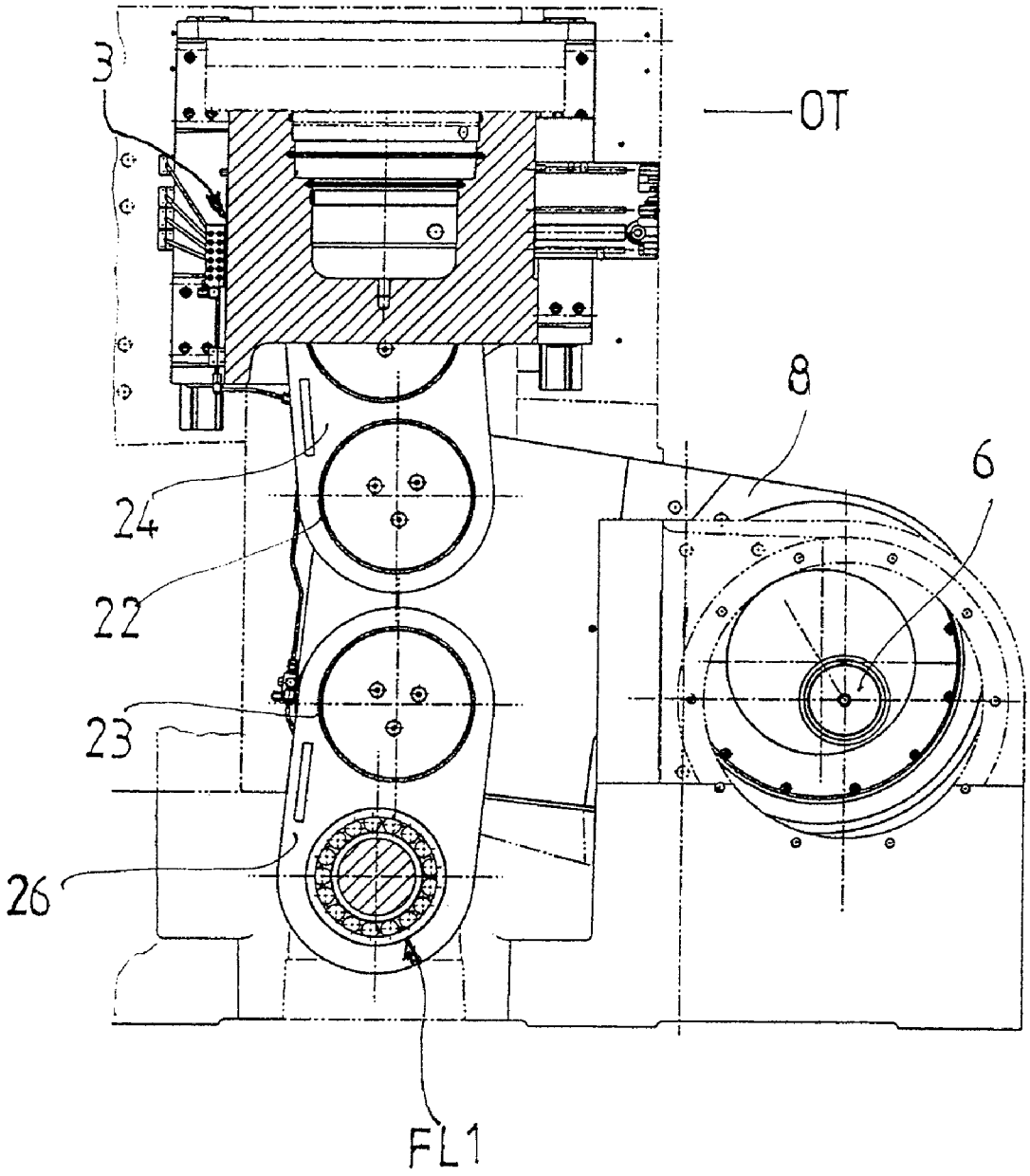
FIG. 5 is a cross-section along the line V-V of FIG. 4.

FIG. 5, a view along line V-V of FIG. 4, illustrates the effective length of the articulated arms 24 and 26 schematically shown in FIG. 3 at the upper dead point of the ram 3.

FIG. 6 shows a perspective view of the coupling piece 33 connecting the shaft ends 32 of the eccentric shafts 6 that face each other. Ends 36 of the eccentric shafts 6 that are opposite the ends 32 that face each other are respectively connected to the three-phase synchronous motors 34, 35 via an epicyclic gear 37.

In the present invention, small motors with high turning moments at low rotation speeds, which motors do not have a flywheel, can be employed as the three-phase synchronous motors 34, 35. Such motors can be used because of the special kinematics of the toggle mechanism according to the present invention, which allows for using torque motors.

The three-phase synchronous motors 34 and 35 operate in parallel. Motors 34 and 35 are each connected to a computer 38 associated with the press machine. The computer 38 processes the machine data and provides the two motors with identical path-time characteristics (see FIG. 7).

The desired machine operating values depend on the machine and process data of the fine blanking or forming operation. The values are determined by a virtual guiding axis. The virtual axis does not actually exist, i.e., it is virtual. The rotation speed and position values of the virtual axis are determined by the computer and fed as actuating variables to the motors in co-ordination with process parameters.

The two torque motors, with regard to the virtual guiding axis, run as slave axes.

FIG. 8 shows a perspective view of the machine frame 2 having O-shaped frame 29 and head piece 39. The head piece 39 is mounted on the O-shaped frame 29 and fixed to the upper part of the O-shaped frame 29 with high-strength screw connections 27. The O-shaped frame 29 is provided with four bores with internal threads, into which externally threaded bolts are screwed. The head piece 39 is fixed by nuts screwed on the bolts.

Figure 9:
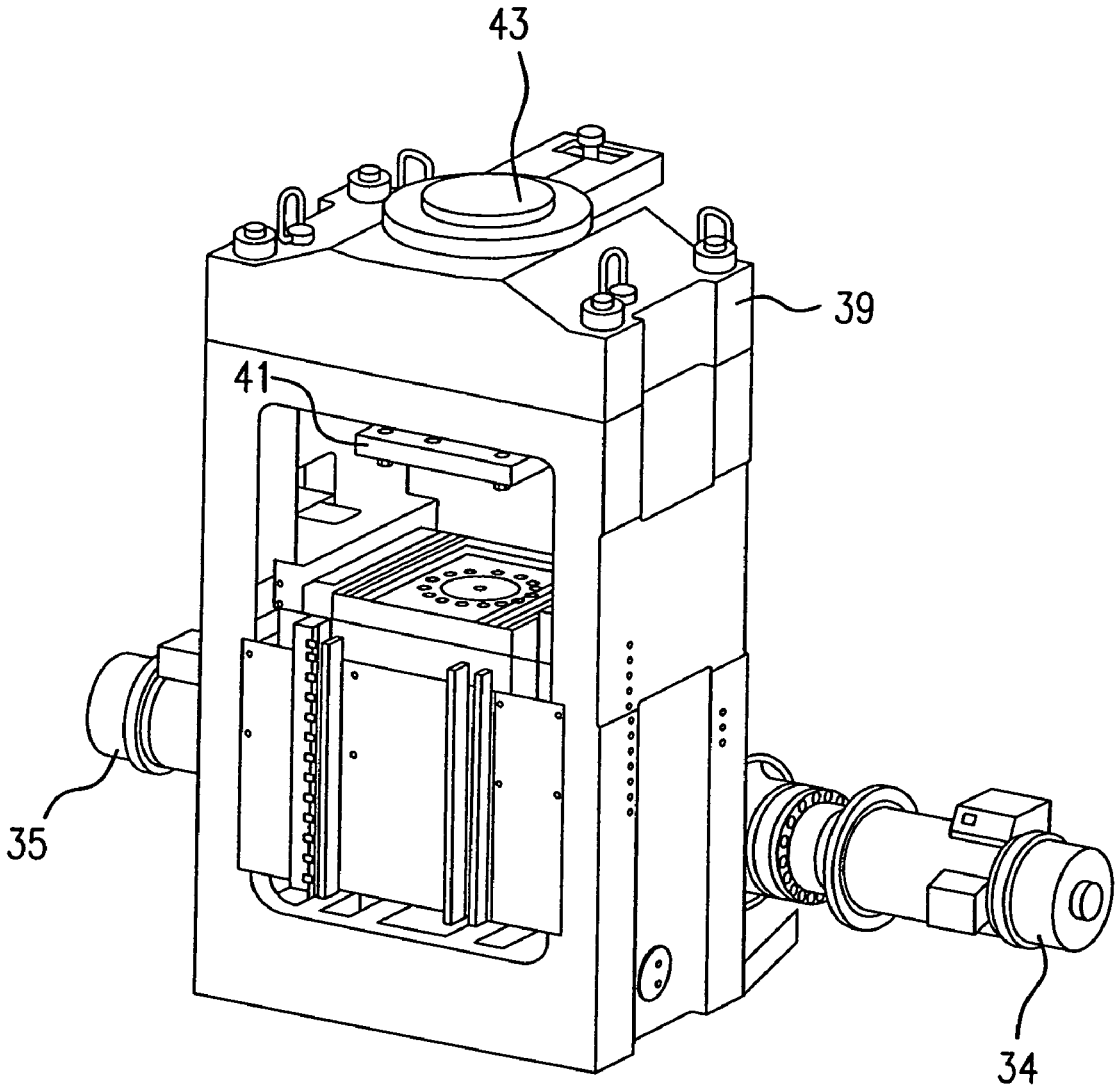
FIG. 9 is another perspective view of the machine frame showing the O-shaped frame with head piece.

A fine blanking or forming head 41 with an upper tool part 43 can be attached to the head piece 39, as shown in FIG. 9. The fine blanking or forming head 41 with an upper tool part 43 can be positioned according to height through the upper opening of the O-shaped frame 29 in a suspended arrangement.

The invention claimed is:

1. A mechanical press for fine blanking, forming and/or stamping of work pieces comprising:

a machine frame including a head piece and an O-shaped frame;

a fine blanking or forming head provided with an upper tool part that is fastened to the head piece;

a ram provided in the O-shaped frame, the ram having a table top to which a lower tool part can be fixed, the ram being actuable in the O-shaped frame along a vertical stroke axis;

a toggle mechanism positioned in the O-shaped frame at a location below the ram, the toggle mechanism having a first side and second side, which first and second sides are respectively positioned on first and second sides of the ram, each of the first and second sides of the toggle mechanism comprising:

a connecting rod having a substantially equilateral triangle shape, the connecting rod having an upper articulation point at a first triangle corner and a lower articulation point at a second triangle corner;

the lower articulation point of the connecting rod being pivotally connected to a first end of a lower articulated arm, the lower articulated arm having a second end that is pivotally connected to a first fixed bearing provided on the O-shaped frame that lies along the vertical stroke axis in which the ram is actuable;

the upper articulation point of the connecting rod being pivotally connected to a first end of an upper articulated arm, the upper articulated arm having a second end that is pivotally connected to the ram;

the connecting rod connected at a third triangle corner to a gear housed in a second fixed bearing provided on the O-shaped frame;

the gear receiving an eccentric shaft having a first end that is connected to a three-phase synchronous motor, wherein the three-phase synchronous motor does not have a flywheel;

whereby motor-driven actuation of the eccentric shaft is translated through the gear to the connecting rod, the upper articulating arm, the connecting rod, and the lower articulated arm, to effect movement of the ram along the vertical stroke axis; and when, during motor-driven actuation, the ram is located at an upper dead point of the vertical stroke axis, the upper articulating arm, the connecting rod, and the lower articulated arm attain an effective length that deviates a few degrees from the vertical stroke axis to thereby have a length that substantially similar to a length of the vertical stroke axis; and a computer controller in connection with and controlling of the three-phase synchronous motor on the first side of the toggle mechanism and the three-phase synchronous motor on the second side of the toggle mechanism.

2. The mechanical press according to claim 1, wherein the second fixed bearing comprises a pair of frame portions having openings in sides thereof and a pocket located between the pair of frame portions, the eccentric shaft being positioned in the openings in the sides and within the pocket.

3. The mechanical press according to claim 1, wherein a coupler provides a coupling connection between a second end of the eccentric shaft on the first side of the toggle mechanism and a second end of the eccentric shaft on the second side of the toggle mechanism.

4. The mechanical press according to any one of claims 1 and 3, wherein the computer controller operates the three-phase synchronous motor on the first side of the toggle mechanism and the three-phase synchronous motor on the second side of the toggle mechanism in unison, with respect to actuation of the ram along the vertical stroke axis.

5. The mechanical press according to claim 1, wherein the eccentric shaft on the first side of the toggle mechanism and the eccentric shaft on the second side of the toggle mechanism are not connected.

6. The mechanical press according to any one of claims 1 and 3, wherein the computer controller operates the three-phase synchronous motor on the first side of the toggle mechanism and the three-phase synchronous motor on the second side of the toggle mechanism independently of each other.

7. The mechanical press according to any one of claims 1 and 5, wherein the three-phase synchronous motor on the first side of the toggle mechanism and the three-phase synchronous motor on the second side of the toggle mechanism provide a high turning moment at low motor rotation speed.

8. The mechanical press according to claim 4, wherein the gear housed in the second fixed bearing is an epicyclical gear.

9. The mechanical press according to claim 6, wherein the gear housed in the second fixed bearing is an epicyclical gear.

10. The mechanical press according to claim 1, wherein the head piece is fastened to the O-shaped frame by externally threaded bolts received in threaded bores provided on the O-shaped frame in a torsionless connection.

11. The mechanical press according to claim 1, wherein the O-shaped frame and the head piece are fabricated of ductile cast iron.

* * * * *